US007681407B2

(12) United States Patent
Thybo et al.

(10) Patent No.: US 7,681,407 B2
(45) Date of Patent: Mar. 23, 2010

(54) METHOD AND A DEVICE FOR DETECTING FLASH GAS

(75) Inventors: Claus Thybo, Soenderborg (DK); Bjarne Dindler Rasmussen, Soenderborg (DK); Steen Lauridsen, Aarhus N (DK); Vagn Helberg, Augustenborg (DK)

(73) Assignee: Danfoss A/S, Nordborg (DK)

( * ) Notice: Subject to any disclaimer, the term of this patent is extended or adjusted under 35 U.S.C. 154(b) by 562 days.

(21) Appl. No.: 10/520,337

(22) PCT Filed: Jul. 3, 2003

(86) PCT No.: PCT/DK03/00468

§ 371 (c)(1),
(2), (4) Date: Mar. 28, 2005

(87) PCT Pub. No.: WO2004/005812

PCT Pub. Date: Jan. 15, 2004

(65) Prior Publication Data

US 2005/0166609 A1 Aug. 4, 2005

(30) Foreign Application Priority Data

Jul. 8, 2002 (DK) ..... 2002 01072

(51) Int. Cl.
*G01K 13/00* (2006.01)

(52) U.S. Cl. ..... 62/129; 62/127; 62/222; 62/225; 374/45; 374/54; 702/114; 702/24; 73/19.1

(58) Field of Classification Search ..... 62/127, 62/129, 222, 225; 73/19.1; 702/24, 114; 374/45, 54

See application file for complete search history.

(56) References Cited

U.S. PATENT DOCUMENTS 2,295,992 A * 9/1942 Gonzalez et al. ..... 62/117
3,171,462 A 3/1965 Reinhart, Jr. ..... 152/355

(Continued)

FOREIGN PATENT DOCUMENTS

CA 2344908 A1 1/2002

(Continued)

OTHER PUBLICATIONS

Wilbert F. Stoecker; Industrial Refrigeration Handbook; 1998; McGraw-Hill Companies, Inc.; pp. 55, 64-68.*

(Continued)

*Primary Examiner*—Frantz F Jules
*Assistant Examiner*—Azim Rahim
(74) *Attorney, Agent, or Firm*—McCormick, Paulding & Huber LLP

(57) ABSTRACT

A method and a device for detecting flash gas in a vapor-compression refrigeration or heat pump system comprising a compressor, a condenser, an expansion device, and an evaporator interconnected by conduits providing a flow path for a refrigerant, by determining a first rate of heat flow of a heat exchange fluid flow across a heat exchanger of the system and a second rate of heat flow of the refrigerant across the heat exchanger, and using the rates of heat flow for establishing an energy balance from which a parameter for monitoring the refrigerant flow is derived, to thereby provide early detection of flash gas with a minimum number of false alarms.

19 Claims, 3 Drawing Sheets

U.S. PATENT DOCUMENTS

| | | | | |
|---|---|---|---|---|
| 3,707,851 | A | 1/1973 | McAshan, Jr. | |
| 3,918,300 | A | 11/1975 | Weisstuch et al. | 73/112 |
| 4,136,528 | A | 1/1979 | Vogel et al. | |
| 4,193,781 | A | 3/1980 | Vogel et al. | |
| 4,325,223 | A | 4/1982 | Cantley | |
| 4,390,058 | A | 6/1983 | Otake et al. | |
| 4,479,727 | A | 10/1984 | Domingorena et al. | |
| 4,500,035 | A | 2/1985 | Kuroda et al. | |
| 4,510,576 | A | 4/1985 | MacArthur et al. | |
| 4,574,870 | A | 3/1986 | Weitman | 165/1 |
| 4,611,470 | A | 9/1986 | Enstrom | |
| 4,614,087 | A | 9/1986 | Nadamoto et al. | 62/126 |
| 4,621,502 | A | 11/1986 | Ibrahim et al. | |
| 4,729,667 | A | 3/1988 | Blangetti et al. | 374/43 |
| 4,766,553 | A | 8/1988 | Kaya et al. | |
| 4,768,346 | A | 9/1988 | Mathur | |
| 4,885,914 | A | 12/1989 | Pearman | |
| 5,079,930 | A | 1/1992 | Beaverson et al. | 62/129 |
| 5,289,692 | A | 3/1994 | Campbell et al. | |
| 5,341,649 | A | 8/1994 | Nevitt et al. | 62/126 |
| 5,363,905 | A | 11/1994 | Rhiel et al. | 165/1 |
| 5,457,965 | A | 10/1995 | Blair et al. | 62/129 |
| 5,596,507 | A | 1/1997 | Jones et al. | |
| 5,615,733 | A | 4/1997 | Yang | |
| 5,623,426 | A | 4/1997 | Ozawa et al. | |
| 5,689,963 | A | 11/1997 | Bahel et al. | |
| 6,089,033 | A | 7/2000 | Dube | |
| 6,128,910 | A | 10/2000 | Faircloth | 62/129 |
| 6,223,544 | B1 * | 5/2001 | Seem | 62/127 |
| 6,225,907 | B1 | 5/2001 | Derryberry et al. | |
| 6,272,868 | B1 | 8/2001 | Grabon et al. | |
| 6,330,802 | B1 | 12/2001 | Cummings et al. | 62/129 |
| 6,460,358 | B1 * | 10/2002 | Hebert | 62/225 |
| 6,543,238 | B2 | 4/2003 | Yamanaka et al. | |
| 6,590,362 | B2 * | 7/2003 | Parlos et al. | 318/799 |
| 2002/0055358 | A1 | 5/2002 | Hebert | |
| 2002/0139128 | A1 | 10/2002 | Suzuki et al. | 62/129 |
| 2003/0019221 | A1 | 1/2003 | Rossi et al. | |
| 2003/0055603 | A1 | 3/2003 | Rossi et al. | |
| 2003/0156999 | A1 * | 8/2003 | Knudsen et al. | 422/132 |
| 2004/0144106 | A1 | 7/2004 | Douglas et al. | |
| 2005/0166608 | A1 | 8/2005 | Thybo | |
| 2005/0172647 | A1 | 8/2005 | Thybo et al. | |
| 2006/0032606 | A1 | 2/2006 | Thybo et al. | |

FOREIGN PATENT DOCUMENTS

| | | | |
|---|---|---|---|
| DE | 2451361 | | 5/1976 |
| EP | 0 155 826 | B1 | 9/1985 |
| EP | 0155826 | B1 | 12/1990 |
| EP | 0453302 | | 10/1991 |
| EP | 0470676 | A2 | 2/1992 |
| EP | 0518035 | A2 | 12/1992 |
| EP | 0559043 | A1 | 9/1993 |
| GB | 2062919 | | 5/1981 |
| JP | 63071625 | A | 1/1988 |
| JP | 63071625 | A | 4/1988 |
| JP | 01174870 | | 7/1989 |
| JP | 5264136 | | 10/1993 |
| JP | 07234043 | | 9/1995 |
| JP | 2001255046 | A * | 9/2001 |
| WO | 8705097 | | 8/1987 |
| WO | 02090832 | A1 | 11/2002 |
| WO | WO 02/090832 | A1 | 11/2002 |

OTHER PUBLICATIONS

Yunus A. Cengel; Michael A. Boles; Thermodynamics; Nov. 27, 2001; McGraw-Hill; 4th Edition; pp. 193-195.*

Richard W. Hamming, Calculus and the Computer Revolution, 1968, The Mathematical Association of AMerica, Inc., pp. 43-57.

International Search Report for Serial No. PCT/DK03/00251 dated Jul. 14, 2003.

International Search Report for Serial No. PCT/DK03/00252 dated Jul. 14, 2003.

International Search Report for Serial No. PCT/DK03/00701 dated Jan. 26, 2004.

Yunus A. Cengel, Michael A. Boles, Thermodynamics, An Engineering Approach, McGraw-Hill, 3rd Edition, pp. 214-217.

European Search Report Issued for related application No. 03 757 722.8 dated Sep. 22, 2005, 3 pages.

* cited by examiner

METHOD AND A DEVICE FOR DETECTING FLASH GAS

CROSS REFERENCE TO RELATED APPLICATIONS

This application is entitled to the benefit of and incorporates by reference essential subject matter disclosed in international Patent Application No. PCT/DK2003/000468 filed on Jul. 3, 2003 and Danish Patent Application No. PA 2002 01072 filed on Jul. 8, 2002.

FIELD OF THE INVENTION

The present invention relates to a method and a flash gas detection device for detecting flash gas in a vapour-compression refrigeration or heat pump system comprising a compressor, a condenser, an expansion device, and an evaporator interconnected by conduits providing a flow path for a refrigerant.

BACKGROUND OF THE INVENTION

In vapour-compression refrigeration or heat pump systems the refrigerant circulates in the system and undergoes phase change and pressure change. In the system a refrigerant gas is compressed in the compressor to achieve a high pressure refrigerant gas, the refrigerant gas is fed to the condenser (heat exchanger), where the refrigerant gas is cooled and condensates, so the refrigerant is in liquid state at the exit from the condenser, expanding the refrigerant in the expansion device to a low pressure and evaporating the refrigerant in the evaporator (heat exchanger) to achieve a low pressure refrigerant gas, which can be fed to the compressor to continue the process.

However, in some cases refrigerant in the gas phase is present in the liquid refrigerant conduits caused by boiling liquid refrigerant. This refrigerant gas in the liquid refrigerant conduits is denoted "flash gas". When flash gas is present at the entry to the expansion device, this seriously reduces the flow capacity of the expansion device by in effect clogging the expansion device, which impairs the efficiency of the system. The effect of this is that the system is using more energy than necessary and possibly not providing the heating or cooling expected, which for instance in a refrigerated display cabinet for shops may lead to warming of food in the cabinet, so the food must be thrown away. Further the components of the system will be outside normal operating envelope. Because of the high load and low mass flow of refrigerant when flash gas is present, the compressor may be subject to overheating, especially in the event that misty oil in the refrigerant is expected to function as lubricant the compressor will undergo a lubrication shortage causing a compressor seizure.

Flash gas may be caused by a number of factors: 1) the condenser is not able to condense all the refrigerant because of high temperature of the heat exchange fluid, 2) there is a low level of refrigerant because of inadequate charging or leaks, 3) the system is not designed properly, e.g. if there is a relatively long conduit without insulation from the condenser to the expansion device leading to a reheating and possibly evaporation of refrigerant, or if there is a relatively large pressure drop in the conduit leading to a possible evaporation of refrigerant.

A leak in the system is a serious problem, as the chosen refrigerant may be hazardous to the health of humans or animals or the environment. Particularly some refrigerants are under suspicion to contribute in the ozone depletion process. In any event the refrigerant is quite expensive and often heavily taxed, so for a typical refrigerated display cabinet for a shop recharging the system will be a considerable expense. Recently a shop having refrigerated display cabinets lost half of the refrigerant in the refrigeration system before it was detected that the refrigeration system had a leak, and recharging of the system was an expense of 75,000 dkr, approximately 10,000 $.

A known way to detect flash gas is to provide a sight glass in a liquid conduit of the system to be able to observe bubbles in the liquid. This is labour and time consuming and further an observation of bubbles may be misleading, as a small amount of bubbles may occasionally be present even in a well functioning system.

Another way is to indirectly detect flash gas by triggering an alarm when the expansion device is fully open, e.g. in the event that the expansion device is an electronic expansion valve or the like. In this case a considerable number of false alarms may be experienced, as a fully open expansion device may occur in a properly functioning system without flash gas.

SUMMARY OF THE INVENTION

An object of the invention is to provide a method for early detection of flash gas with a minimum number of false alarms.

This object is met by a method comprising the steps of determining a first rate of heat flow of a heat exchange fluid flow across a heat exchanger of the system and a second rate of heat flow of the refrigerant across the heat exchanger, and using the rates of heat flow for establishing an energy balance from which a parameter for monitoring the refrigerant flow is derived. Hereby it is possible to monitor the refrigerant flow without direct measurement using a flow meter. Such flow meters are expensive and may further restrict the flow.

According to an embodiment, the heat exchanger is the evaporator, which is the ideal component.

According to an alternative or additional embodiment, the heat exchanger is the condenser.

As will be appreciated by the skilled person the first rate of heat flow of the heat exchange fluid can be established in different ways, but according to an embodiment the method comprises establishing the first rate of heat flow by establishing a heat exchange fluid mass flow and a specific enthalpy change of the heat exchange fluid across the heat exchanger.

According to an embodiment, the method comprises establishing the heat exchange fluid mass flow as a constant based on empirical data or on data obtained under faultless operation of the system.

According to an embodiment, the method comprises establishing the specific enthalpy change of the heat exchange fluid across the heat exchanger based on measurements of the heat exchange fluid temperature before and after the heat exchanger.

The second rate of heat flow of the refrigerant may by determined by establishing a refrigerant mass flow and a specific enthalpy change of the refrigerant across the heat exchanger.

The refrigerant mass flow may be established in different ways, including direct measurement, which is, however, not preferred. According to an embodiment, the method comprises establishing the refrigerant mass flow based on a flow characteristic of the expansion device, and the expansion device opening passage and/or opening period, and an absolute pressure before and after the expansion device, and if necessary any subcooling of the refrigerant at the expansion device entry.

The specific enthalpy difference of the refrigerant flow may be established based on registering the temperature and pressure of the refrigerant at expansion device entry and registering the refrigerant evaporator exit temperature and the refrigerant evaporator exit pressure or the saturation temperature of the refrigerant at the evaporator inlet.

A direct evaluation of the refrigerant mass flow is possible, but may however be subject to some disadvantages, e.g. because of fluctuations or variations of the parameters in the refrigeration or heat pump system, and it is hence preferred that the method comprises establishing a residual as difference between the first rate of heat flow and the second rate of heat flow.

To further reduce the sensibility to fluctuations or variations of parameters in the system and be able to register a trend in the refrigerant mass flow at an early time, the method may comprise providing a fault indicator by means of the residual, the fault indicator being provided according to the formula:

$$S_{\mu_1,i} = \begin{cases} S_{\mu_1,i-1} + s_i, \text{ when } S_{\mu_1,i-1} + s_{\mu_1,i} > 0 \\ 0, \text{ when } S_{\mu_1,i-1} + s_{\mu_1,i} \leq 0 \end{cases}$$

where $s_{\mu_1,i}$ is calculated according to the following equation:

$$S_{\mu_1,i} = -k_1\left(r_i - \frac{\mu_0 + \mu_1}{2}\right) \text{ where}$$

$r_i$: residual $k_1$: proportionality constant $\mu_0$: first sensibility value $\mu_1$: second sensibility value.

According to a second aspect the invention regards a flash gas detection device, which comprises means for determining a first rate of heat flow of a heat exchange fluid flow across a heat exchanger of the system and a second rate of heat flow of the refrigerant across the heat exchanger, and using the rates of heat flow for establishing an energy balance from which a parameter for monitoring the refrigerant flow is derived, the device further comprising evaluation means for evaluating the refrigerant mass flow, and generate an output signal.

According to an embodiment of the device, the means for determining the first rate of heat flow comprises means for sensing heat exchange fluid temperature before and after a heat exchanger.

According to an embodiment of the device, the means for determining the second rate of heat flow comprises means for sensing the refrigerant temperature and pressure at expansion device entry, and means for sensing the refrigerant temperature at evaporator exit, and means for establishing the pressure at the expansion device exit or the saturation temperature.

According to an embodiment of the device, the means for establishing the second rate of heat flow comprises means for sensing absolute refrigerant pressure before and after the expansion device and means for establishing an opening passage or opening period of the expansion device.

To provide a robust evaluation means, the evaluation means may comprise means for establishing a residual as difference between a first value, which is made up of the mass flow of the heat exchange fluid flow and the specific enthalpy change across a heat exchanger of the system, and a second value, which is made up of the refrigerant mass flow and the specific refrigerant enthalpy change across a heat exchanger of the system.

To be able to evaluate a trend in the output signal, the device may further comprise memory means for storing the output signal and means for comparing said output signal with a previously stored output signal.

BRIEF DESCRIPTION OF THE DRAWINGS

In the following, the invention will be described in detail with reference to the drawing, where.

DETAILED DESCRIPTION OF THE PREFERRED EMBODIMENTS

In the following reference will be made to a simple refrigeration system, although the principle is equally applicable to a heat pump system, and as understood by the skilled person, the invention is in no way restricted to a refrigeration system.

Figure 1:
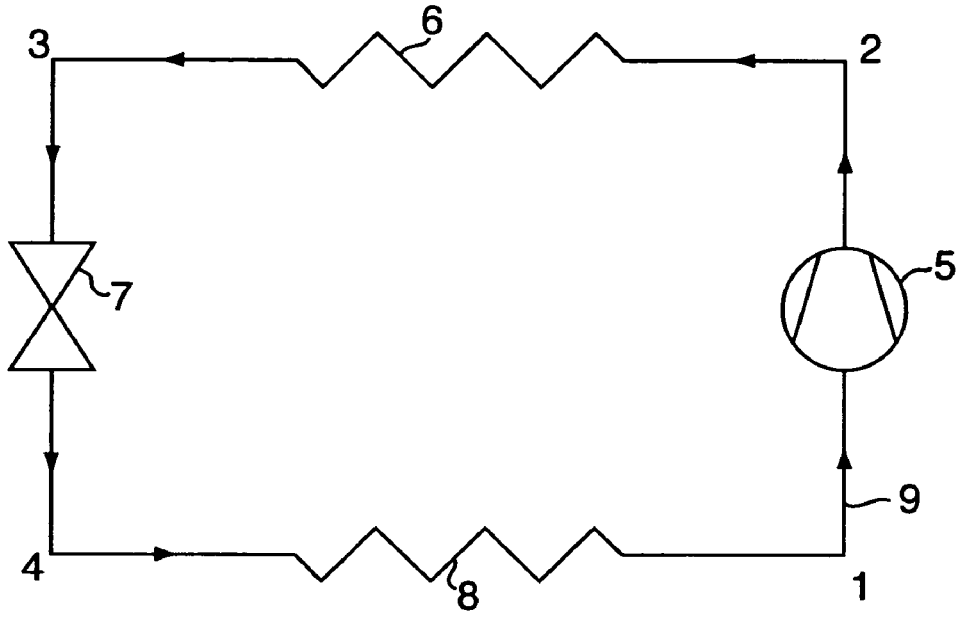
FIG. 1 is a sketch of a simple refrigeration system or heat pump system.

A simple refrigeration system is shown in FIG. 1. The system comprises a compressor 5, a condenser 6, an expansion device 7 and an evaporator 8 interconnected by conduits 9 in which a refrigerant is flowing. The mode of operation of the system is well known and comprises compression of a gaseous refrigerant from a temperature and pressure at point 1 before the compressor 5 to a higher temperature and pressure at point 2 after the compressor 5, condensing the refrigerant under heat exchange with a heat exchange fluid in the condenser 6 to achieve liquid refrigerant at high pressure at point 3 after the condenser 6. The high-pressure refrigerant liquid is expanded in the expansion device 7 to a mixture of liquid and gaseous refrigerant at low pressure at point 4 after the expansion device. In this simple example, the expansion device is an expansion valve, but other types of expansion devices are possible, e.g. a turbine, an orifice or a capillary tube. After the expansion device, the mixture flows into the evaporator 8, where the liquid is evaporated by heat exchange with a heat exchange fluid in the evaporator 8. In this simple example, the heat exchange fluid is air, but the principle applies equally to refrigeration or heat pump systems using another heat exchange fluid, e.g. brine, and further the heat exchange fluid in the condenser and the evaporator need not be the same.

Figure 2:
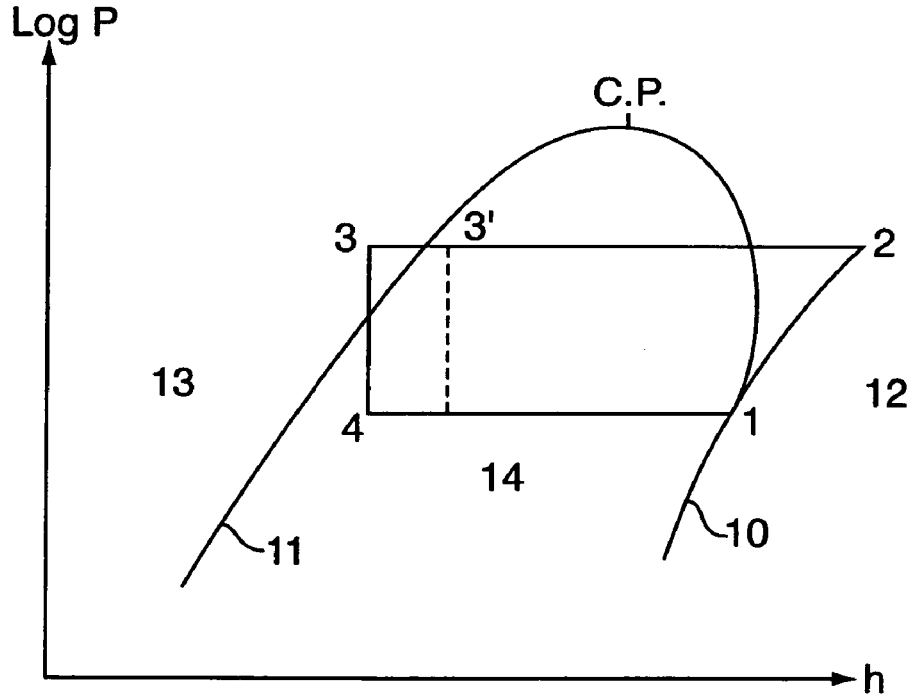
FIG. 2 is a schematic log p, h-diagram of a cycle of the system according to FIG. 1.

FIG. 2 is a log p, h-diagram of the refrigeration system according to FIG. 1, showing pressure and enthalpy of the refrigerant. Reference numeral 10 denotes the saturated vapour curve, 11 the saturated liquid curve and C.P. the critical point. In the region 12 to the right of saturated vapour line 10, the refrigerant is hence superheated gas, while in the region 13 to the left of the saturated liquid line 11, the refrigerant is subcooled liquid. In the region 14, the refrigerant is a mixture of gas and liquid. As can be seen, at point 1 before the compressor, the refrigerant is completely gaseous and during the compression, the pressure and temperature of the refrigerant is raised, so at point 2 after the compressor, the refrigerant is a superheated gas at high pressure. The refrigerant leaving the condenser 6 at point 3 should be completely liquid, i.e. the refrigerant should be at a state on the saturated liquid curve 11 or in the region 13 of subcooled liquid refrigerant. In the expansion device 7, the refrigerant is expanded to a mixture of liquid and gas at a lower pressure at point 4 after the expansion device 7. In the evaporator 8, the refrigerant evaporates at constant pressure by heat exchange with a heat exchange fluid so as to become completely gaseous at the exit of the evaporator at point 1.

If, as indicated by point 3', the refrigerant entering the expansion device 7 is a mixture of liquid and gas, the previously mentioned flash gas, then the refrigerant mass flow is restricted as previously mentioned and the cooling capacity of the evaporator 8 of the refrigeration system is significantly reduced. Further, but less significant the available enthalpy difference in the evaporator 8 is reduced, which also reduces the cooling capacity.

Figure 3:
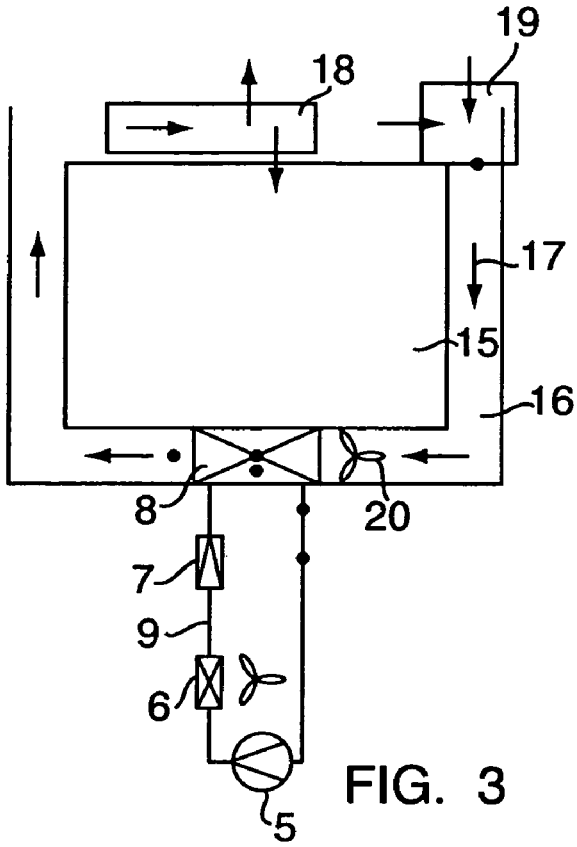
FIG. 3 is a sketch of a refrigerated display cabinet comprising the refrigeration system according to FIG. 1.

FIG. 3 shows schematically a refrigerated display cabinet comprising a refrigeration system. Refrigerated display cabinets are i.a. used in supermarkets to display and sell cooled or frozen food. The refrigerated display cabinet comprises a storage compartment 15, in which the food is stored. An air channel 16 is arranged around the storage compartment 15, i.e. the air channel 16 run on both sides of and under the storage compartment 15. After travel through the air channel 16, an air stream 17, shown by arrows, enters a cooling zone 18 over the cooling compartment 15. The air is then again lead to the entrance to the air channel 16, where a mixing zone 19 is present. In the mixing zone 19 the air stream 17 is mixed with ambient air. Thereby air, which has entered the storage compartment or somehow escaped into the surroundings, is substituted. In the air channel 16 is provided a blower device 20, which can be made up of one or more fans. The blowing device 20 ensures that the air stream 17 can be moved in the air channel 16. The refrigerated display cabinet comprises part of a simple refrigeration system as outlined in FIG. 1, as an evaporator 8 of the system is placed in the air channel 16. The evaporator 8 is a heat exchanger exchanging heat between the refrigerant in the refrigeration system and the air stream 17. In the evaporator 8 the refrigerant takes up heat from the air stream 17, which is cooled thereby. The cycle of the refrigeration system is as described with regard to FIGS. 1 and 2, and with the numerals used therein.

As mentioned, it is highly advantageous in a refrigeration or heat pump system to be able to detect flash gas, i.e. the presence of gas at the expansion device entry. The effect of flash gas is a reduced mass flow through the expansion device when compared to the mass flow in the normal situation of solely liquid refrigerant at the expansion device entry. When the refrigerant mass flow in the refrigeration system is less than the theoretical refrigerant mass flow provided solely liquid phase refrigerant at the expansion device entry, this difference is an indication of the presence of flash gas. The refrigerant mass flow may be established by direct measurement using a flow meter. Such flow meters are, however, relatively expensive, and may further restrict the flow creating a pressure drop, which may in itself lead to flash gas formation, and certainly impairs the efficiency of the system. It is therefore preferred to establish the refrigerant mass flow by other means, and one possible way is to establish the refrigerant mass flow based on the principle of conservation of energy or energy balance of one of the heat exchangers of the refrigeration system, i.e. the evaporator 8 or the condenser 6. In the following reference will be made to the evaporator 8, but as will be appreciated by the skilled person the condenser 6 could equally be used.

The energy balance of the evaporator 8 is based the following equation:

$$\dot{Q}_{Air}=\dot{Q}_{Ref} \tag{1}$$

where $\dot{Q}_{Air}$ is the heat removed from the air per time unit, i.e. the rate of heat flow delivered by the air, and $\dot{Q}_{Ref}$ the heat taken up by the refrigerant per time unit, i.e. the rate of heat flow delivered to the refrigerant.

The basis for establishing the rate of heat flow of the refrigerant ($\dot{Q}_{Ref}$) i.e. the heat delivered to the refrigerant per time unit is the following equation:

$$\dot{Q}_{Ref}=\dot{m}_{Ref}(h_{Ref,Out}-h_{Ref,In}) \tag{2}$$

where $\dot{m}_{Ref}$ is the refrigerant mass flow. $h_{Ref,Out}$ is the specific enthalpy of the refrigerant at the evaporator exit, and $h_{Ref,In}$ is the specific enthalpy of the refrigerant at the evaporator entry. The specific enthalpy of a refrigerant is a material and state property of the refrigerant, and the specific enthalpy can be determined for any refrigerant. The refrigerant manufacturer provides a log p, h-diagram of the type according to FIG. 2 for the refrigerant. With the aid of this diagram the specific enthalpy difference across the evaporator can be established. For example to establish $h_{Ref,In}$ with the aid of a log p, h-diagram, it is only necessary to know the temperature and the pressure of the refrigerant at the expansion device entry ($T_{Ref,In}$ and $P_{Con}$, respectively) . Those parameters may be measured with the aid of a temperature sensor or a pressure sensor. Measurement points and parameters measurement points and parameters of the evaporator 8 and the refrigeration system can be seen in FIG. 4, which is a sketch showing a part of the refrigerated display cabinet according to FIG. 3.

To establish the specific enthalpy at the evaporator exit, two measurement values are needed: the temperature at evaporator exit ($T_{Ref,out}$) and either the pressure at the exit ($P_{Ref,\ out}$) or the saturation temperature ($T_{Ref,sat}$) . The temperature at the exit of the evaporator 8 can be measured with a temperature sensor, and the pressure at the exit can be measured with a pressure sensor.

Instead of the log p, h-diagram, it is naturally also possible to use values from a chart or table, which simplifies calculation with the aid of a processor. Frequently the refrigerant manufacturers also provide equations of state for the refrigerant.

The mass flow of the refrigerant may be established by assuming solely liquid phase refrigerant at the expansion device entry. In refrigeration systems having an electronically controlled expansion valve, e.g. using pulse width modulation, it is possible to determine the theoretical refrigerant mass flow based on the opening passage and/or the opening period of the valve, when the difference of absolute pressure across the valve and the subcooling ($T_{V,in}$) at the expansion valve entry is known. Similarly the refrigerant mass flow can be established in refrigeration systems using an expansion device having a well-known opening passage e.g. fixed orifice or a capillary tube. In most systems the above-mentioned parameters are already known, as pressure sensors are present, which measure the pressure in condenser 6. In many cases the subcooling is approximately constant, small and possible to estimate, and therefore does not need to be measured. The theoretical refrigerant mass flow through the expansion valve can then be calculated by means of a valve characteristic, the pressure differential, the subcooling and the valve opening passage and/or valve opening period. With many pulse width modulated expansion valves it is found for constant subcooling that the theoretical refrigerant mass flow is approximately proportional to the difference between the absolute pressures before and after and the opening period of the valve. In this case the theoretical mass flow can be calculated according to the following equation:

$$\dot{m}_{Ref}=k_{exp}\cdot(P_{con}-P_{Ref,out})\cdot OP \quad (3)$$

where $P_{Con}$ is the absolute pressure in the condenser, $P_{Ref,out}$ the pressure in the evaporator, OP the opening period and $k_{Exp}$ a proportionality constant, which depend on the valve and subcooling. In some cases the subcooling of the refrigerant is so large, that it is necessary to measure the subcooling, as the refrigerant flow through the expansion valve is influenced by the subcooling. In a lot of cases it is however only necessary to establish the absolute pressure before and after the valve and the opening passage and/or opening period of the valve, as the subcooling is a small and fairly constant value, and subcooling can then be taken into consideration in a valve characteristic or a proportionality constant.

Similarly the rate of heat flow heat of the air ($\dot{Q}_{Air}$), i.e. the heat taken up by the air per time unit may be established according to the equation:

$$\dot{Q}_{Air}=\dot{m}_{Air}(h_{Air,in}-h_{Air,out}) \quad (4)$$

where $\dot{m}_{Air}$ is the mass flow of air per time unit, $h_{Air,in}$ is the specific enthalpy of the air before the evaporator, and $h_{Air,out}$ is the specific enthalpy of the air after the evaporator.

The specific enthalpy of the air can be calculated based on the following equation:

$$h_{Air}=1{,}006\cdot t+x(2501+1.8\cdot t),[h]=\text{kJ/kg} \quad (5)$$

where t is the temperature of the air, i.e. $T_{EVa,in}$ before the evaporator and $T_{EVa,out}$ after the evaporator. x denotes the absolute humidity of the air. The absolute humidity of the air can be calculated by the following equation:

$$x = 0{,}62198\cdot\frac{p_W}{p_{Amb}-p_W} \quad (6)$$

Here $p_W$ is the partial pressure of the water vapour in the air, and $p_{Amb}$ is the air pressure. $p_{Amb}$ can either be measured or a standard atmosphere pressure can simply be used. The deviation of the real pressure from the standard atmosphere pressure is not of significant importance in the calculation of the amount of heat per time unit delivered by the air. The partial pressure of the water vapour is determined by means of the relative humidity of the air and the saturated water vapour pressure and can be calculated by means of the following equation:

$$P_W=P_{W,Sat}\cdot RH \quad (7)$$

Here RH is the relative humidity of the air and $p_{W,Sat}$ the saturated pressure of the water vapour. $p_{W,Sat}$ is solely dependent on the temperature, and can be found in thermodynamic reference books. The relative humidity of the air can be measured or a typical value can be used in the calculation.

When equations (2) and (4) is set to be equal, as implied in equation (1), the following is found:

$$\dot{m}_{Ref}(h_{Ref,Out}-h_{Ref,In})=\dot{m}_{Air}(h_{Air,In}-h_{Air,Out}) \quad (8)$$

From this the air mass flow $\dot{m}_{Air}$ can be found by isolating $\dot{m}_{Air}$:

$$\dot{m}_{Air} = \dot{m}_{Ref}\cdot\frac{(h_{Ref,Out}-h_{Ref,In})}{(h_{Air,In}-h_{Air,Out})} \quad (9)$$

Assuming faultless air flow this equation can be used the evaluate the operation of the system.

In many cases it is recommended to register the theoretical air mass flow in the system. As an example this theoretical air mass flow can be registered as an average over a certain time period, in which the refrigeration system is running under stabile and faultless operating conditions. Such a time period could as an example be 100 minutes.

Figure 4:
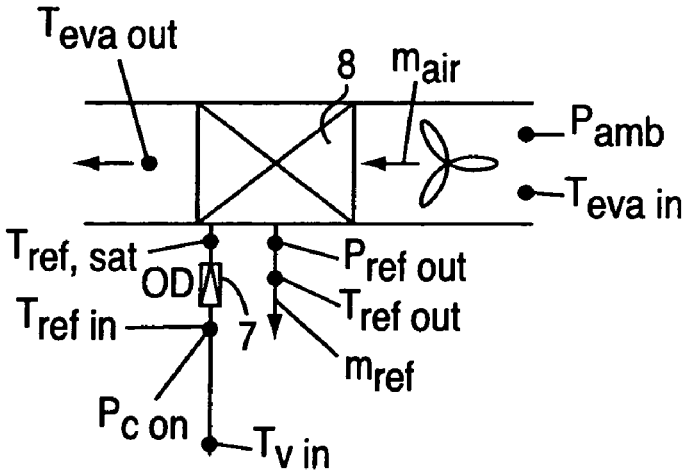
FIG. 4 is a sketch showing a part of the refrigerated display cabinet according to FIG. 3.

A certain difficulty lies in the fact that the signals from the different sensors (thermometers, pressure sensors) are subject to significant variation. These variations can be in opposite phase, so a signal for the theoretical refrigerant mass flow is achieved, which provides certain difficulties in the analysis. These variations or fluctuations are a result of the dynamic conditions in the refrigeration system. It is therefore advantageous regularly, e.g. once per minute, to establish a value, which in the following will be denoted "residual", based on the energy balance according to equation (1):

$$r=\dot{Q}_{Air}-\dot{Q}_{Ref}$$

so based on the equations (2) and (4), the residual can be found as:

$$r = \bar{\dot{m}}_{Air}(h_{Air,In}-h_{Air,Out})-\dot{m}_{Ref}(h_{Ref,Out}-h_{Ref,In}) \quad (10)$$

where $$\bar{\dot{m}}_{Air}$$

is the estimated air mass flow, which is established as mentioned above, i.e. as an average during a period of faultless operation. Another possibility is to assume that $$\bar{\dot{m}}_{Air}$$

is a constant value, which could be established in the very simple example of a refrigerated display cabinet as in FIGS. 3 and 4 having a constantly running blower.

In a refrigeration system operating faultlessly, the residual r has an average value of zero, although it is subject to considerable variations. To be able to early detect a fault, which shows as a trend in the residual, it is presumed that the registered value for the residual r is subject to a Gaussian distribution about an average value and independent whether the refrigeration system is working faultless or a fault has arisen.

In principle the residual should be zero no matter whether a fault is present in the system or not, as the principle of conservation of energy or energy balance of course is eternal. When it is not the case in the above equations, it is because the prerequisite for the use of the equations used is not fulfilled in the event of a fault in the system.

In the event of flash gas in the expansion device, the valve characteristic changes, so that $k_{Exp}$ becomes several times smaller. This is not taken into account in the calculation, so the rate of heat flow of the refrigerant $\dot{Q}_{Ref}$ used in the equations is very much larger than in reality. For the rate of heat flow of the air ($\dot{Q}_{Air}$), the calculation is correct (assuming a fault causing reduced air flow across the heat exchanger has not occurred), which means that the calculated value for the rate of heat flow of the air ($\dot{Q}_{Air}$) across the heat exchanger equals the rate of heat flow of the air in reality. The consequence is that the average of the residual becomes negative in the event of flash gas in the expansion device.

In the event of a fault causing reduced air flow across the heat exchanger (a defect blower or icing up of the heat exchanger) the mass flow of air is less than the value for the mass flow of air $$\bar{m}_{Air}$$

used in the calculations. This means that the rate of heat flow of the air used in the calculations is larger than the actual rate of heat flow of the air in reality, i.e. less heat per unit time is removed from the air than expected. The consequence (assuming correct rate of heat flow of the refrigerant, i.e. no flash gas), is that the residual becomes positive in the event of a fault causing reduced air flow across the heat exchanger.

To filter the residual signal for any fluctuations and oscillations statistical operations are performed by investigating the following hypotheses:

1. The average value of the residual r is $\mu_1$ (where $\mu_1<0$). Corresponding to a test for flash gas.

2. The average value of the residual r is $\mu_2$ (where $\mu_2>0$). Corresponding to a test for reduced air flow.

The investigation is performed by calculating two fault indicators according to the following equations:

1. Test for Flash Gas:

$$S_{\mu_1,i} = \begin{cases} S_{\mu_1,i-1} + s_i, \text{ when } S_{\mu_1,i-1} + s_{\mu_1,i} > 0 \\ 0, \text{ when } S_{\mu_1,i-1} + s_{\mu_1,i} \le 0 \end{cases} \tag{11}$$

where $S_{\mu_1,i}$ is calculated according to the following equation:

$$s_{\mu_1,i} = -k_1\left(r_i - \frac{\mu_0 + \mu_1}{2}\right) \tag{12}$$

where $k_1$ is a proportionality constant, $\mu_0$ a first sensibility value, $\mu_1$ a second sensibility value, which is negative as indicated above.

2. Test for Reduced Air Flow:

$$S_{\mu_2,i} = \begin{cases} S_{\mu_2,i-1} + s_i, \text{ when } S_{\mu_2,i-1} + s_{\mu_2,i} > 0 \\ 0, \text{ when } S_{\mu_2,i-1} + s_{\mu_2,i} \le 0 \end{cases} \tag{13}$$

where $S_{\mu_2,i}$ is calculated according to the following equation:

$$s_{\mu_2,i} = k_1\left(r_i - \frac{\mu_0 + \mu_2}{2}\right) \tag{14}$$

where $k_1$ is a proportionality constant, $\mu_0$ a first sensibility value, $\mu_2$ a second sensibility value, which is positive as indicated above.

In equation (11) it is naturally presupposed that the fault indicator $S_{\mu_1,i}$, i.e. at the first point in time, is set to zero. F or a later point in time is used $S_{\mu_1,i}$ according to equation (12), and the sum of this value and the fault indicator $S_{\mu_1,i}$ at a previous point in time is computed. When this sum is larger than zero, the fault indicator is set to this new value. When this sum equals or is less than zero, the fault indicator is set to zero. In the simplest case $\mu_0$ is set to zero. $\mu_1$ is a chosen value, which e.g. establish that a fault has arisen. The parameter $\mu_1$ is a criterion for how often it is accepted to have a false alarm regarding flash gas detection.

Similarly in equation (13) it is naturally presupposed that the fault indicator $S_{\mu_2,i}$, i.e. at the first point in time, is set to zero. For a later point in time is used $S_{\mu_2,i}$ according to equation (14), and the sum of this value and the fault indicator $S_{\mu_2,i}$ at a previous point in time is computed. When this sum is larger than zero, the fault indicator is set to this new value. When this sum equals or is less than zero, the fault indicator is set to zero. In the simplest case $\mu_0$ can be set to zero. $\mu_2$ is an estimated value, which e.g. establish that a fault has arisen. The parameter $\mu_2$ is a criterion for how often is it accepted to have a false alarm regarding the air mass flow.

When for example a fault occurs in that flash gas is present at the expansion valve entry, then the fault indicator will grow, as the periodically registered values of the $S_{\mu_1,i}$ in average is larger than zero. When the fault indicator reaches a predetermined value an alarm is activated, the alarm showing that the refrigerant mass flow is reduced. If a smaller value of $\mu_1$ is chosen, i.e. a more negative value, fewer false alarms are experienced, but there exist a risk of reducing sensitivity for detection of a fault.

Figure 5:
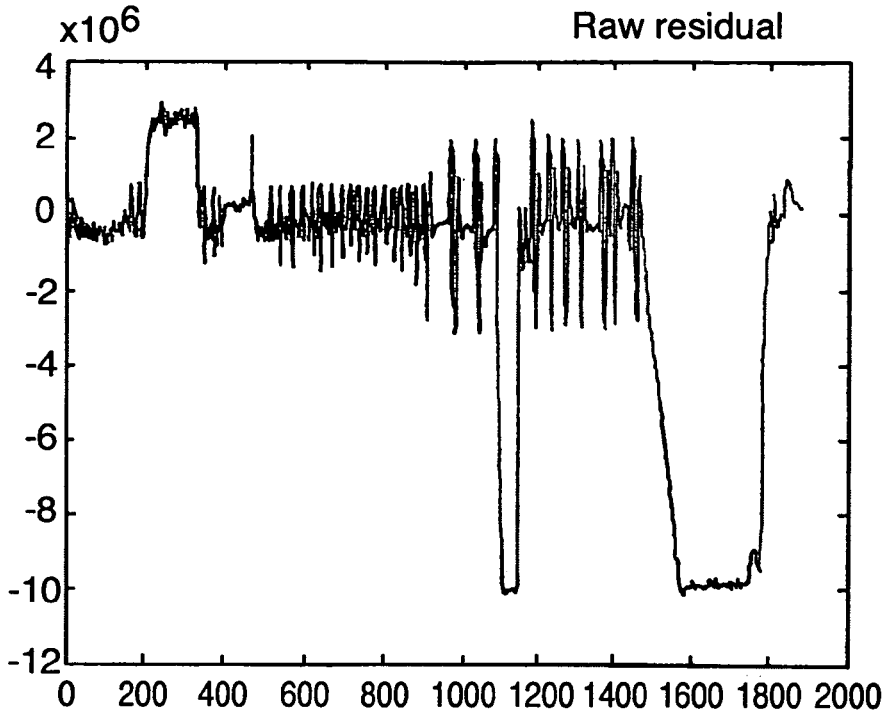
FIG. 5 is a diagram of a residual in a fault situation.
Figure 6:
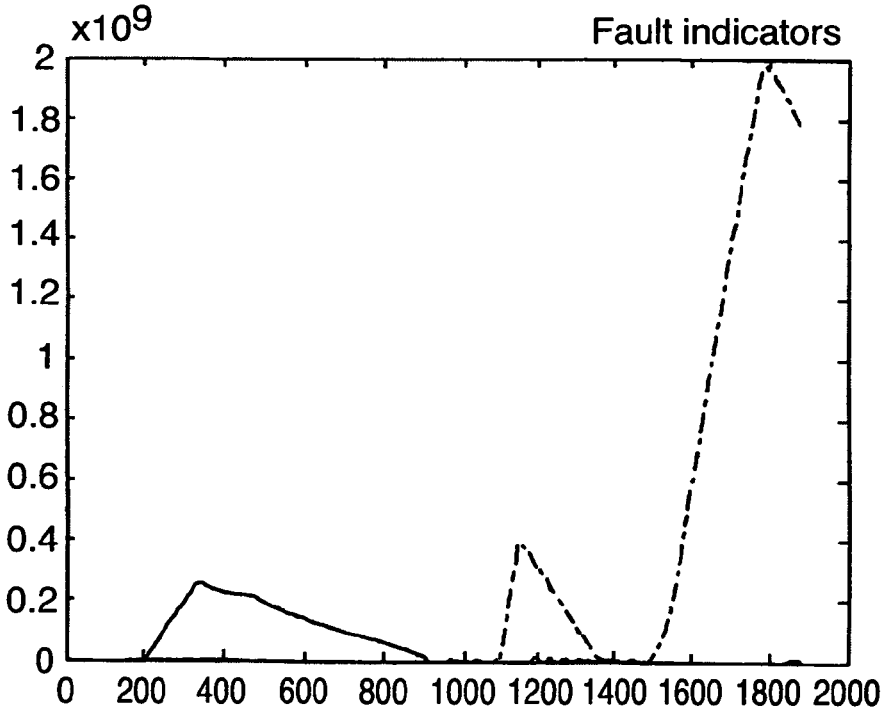
FIG. 6 is a diagram of a fault indicator in the fault situation according to FIG. 5.

The principle of operation of the filtering according to equation (11) and (13) shall be illustrated by means of FIGS. 5 and 6. In FIG. 5 the time in minutes is on the x-axis and on the y-axis the residual r. Between t=200 and 300 minutes a blower fault was present, which gave rise to a significant rise in the residual. Further in the periods t=1090 to 1147 and t=1455 to 1780, flash gas is present, which can be seen as a significant reduction of the residual to a value of about $-10\times10^6$. However, as can be seen the signal is subject to quite significant fluctuations and variations, which makes evaluation difficult.

The different fault situations can be seen from FIG. 5, but a better possibility of identification is present when monitoring the fault indicators $S_{\mu_1,i}$ and $S_{\mu_2,i}$, the behaviour of which can seen in FIG. 6, where the dot-dash line denotes $S_{\mu_1,i}$ and the continuous line denotes the $S_{\mu_2,i}$. Here the value of the fault indicators $S_{\mu_1,i}$, $S_{\mu_2,i}$ is on the y-axis and the time in minutes is on the x-axis. The fault indicator $S_{\mu_2,i}$ grows continuously in the period between t=200 and 330 minutes because of the blower fault. An alarm can be triggered when $S_{\mu_2,i}$ exceeds a value of e.g. $0.2\times10^9$. As can be seen by comparison of FIGS. 5 and 6 early detection is possible, especially when using the fault indicator. Similarly the fault indicator $S_{\mu_1,i}$ rises in the period between t=1090 to 1147 because of flash gas, then gradually reduces back to zero and then rises again in the period t=1455 to 1780, when flash gas again is present at the expansion valve entry. The fault indicators $S_{\mu_1,i}$, $S_{\mu_2,i}$ could be set back to zero, when the refrigeration system has been working faultless long enough. In praxis the fault indicators $S_{\mu_1,i}$, $S_{\mu_2,i}$ would anyway be set to zero when a fault is corrected.

As can be seen in FIGS. 5 and 6 it is hence possible simultaneously to evaluate the system for reduced air flow and flash gas at the expansion device entry by evaluating the fault indicators using the criterions $u\mu_1$ and $\mu_2$.

Further by means of the method and device according to the invention, it is possible to gain valuable information about the design of the refrigeration system. Many refrigeration systems are tailor made for the specific use, e.g. for a shop having one or more refrigerated display cabinets, and some times these refrigeration systems are not optimal, i.e. because of long conduits, pressure drops because of bends of the conduits or the like, or conduits exposed to heating by the environment. With the method and device it will be possible to detect that the refrigeration system is not optimal, and an expert could be sent for to evaluate the system and propose improvements of the system and/or propose improvements for future systems.

A further advantage of the device is that it may be retrofitted to any refrigeration or heat pump system without any major intervention in the refrigeration system. The device uses signals from sensors, which are normally already present in the refrigeration system, or sensors, which can be retrofitted at a very low price.

In the preceding description a simple example was used to illustrate the principle of the invention, but as will be readily understood by the skilled person, the invention can be applied to a more complex system having a plurality of heat exchangers, i.e. more than one condenser and/or more than one evaporator.

The invention claimed is:

1. A flash gas detection device for a vapour-compression refrigeration or heat pump system comprising a compressor, a condenser, an expansion device, and an evaporator interconnected by conduits providing a flow path for a refrigerant, wherein the device comprises:

means for determining a first rate of heat flow of a heat exchange fluid flow across a heat exchanger of the system and a second rate of heat flow of the refrigerant across the heat exchanger, and using the rates of heat flow for establishing an energy balance from which a residual for monitoring the refrigerant mass flow is derived; and evaluation means for evaluating the refrigerant mass flow, and providing an output signal indicating the presence or absence of flash gas, based on the residual, wherein the means for determining the second rate of heat flow uses inputs from means for sensing absolute refrigerant pressure before and after the expansion device, means for establishing an opening passage or opening period of the expansion device, and means for storing a value representing a flow characteristic of the expansion device, without requiring measurement of refrigerant temperature at the expansion device entry and exit.

2. The device according to claim 1, wherein the heat exchanger is the evaporator.

3. The device according to claim 1, wherein the heat exchanger is the condenser.

4. The device according to claim 1, wherein the means for determining the first rate of heat flow establishes a heat exchange fluid mass flow and a specific enthalpy change of the heat exchange fluid across the heat exchanger.

5. The device according to claim 4, wherein the means for determining the first rate of heat flow establishes the heat exchange fluid mass flow as a constant based on empirical data or based on data obtained under faultless operation of the system.

6. The device according to claim 4, wherein the means for determining the first rate of heat flow comprises means for sensing heat exchange fluid temperature before and after the heat exchanger.

7. The device according to claim 1, wherein the means for determining the second rate of heat flow establishes the refrigerant mass flow and a specific enthalpy change of the refrigerant across the heat exchanger.

8. The device according to claim 1, wherein the means for determining the second rate of heat flow establishes the refrigerant mass flow based on the flow characteristic of the expansion device, and the expansion device opening passage and/or opening period, and an absolute pressure before and after the expansion device, without measuring subcooling of the refrigerant at the expansion device entry.

9. The device according to claim 1, wherein the means for determining the second rate of heat flow establishes the specific enthalpy difference of the refrigerant flow based on registering the pressure of the refrigerant at the expansion device entry and the refrigerant evaporator exit pressure or the saturation temperature of the refrigerant at the evaporator inlet.

10. The device according to claim 1, wherein the residual is derived as a difference between the first rate of heat flow and the second rate of heat flow.

11. The device according to claim 10, wherein the evaluation means evaluates the refrigerant mass flow by means of a fault indicator $S_{\mu_1,i}$ provided according to the formula:

$$S_{\mu_1,i} = \begin{cases} S_{\mu_1,i-1} + s_i, \text{ when } S_{\mu_1,i-1} + s_{\mu_1,i} > 0 \\ 0, \text{ when } S_{\mu_1,i-1} + s_{\mu_1,i} \leq 0 \end{cases}$$

where $s_{\mu_1,i}$ is calculated according to the following equation:

$$s_{\mu_1,i} = -k_1\left(r_i - \frac{\mu_0 + \mu_1}{2}\right)$$

where $r_i$: residual $k_1$: proportionality constant $\mu_0$: first sensibility value $\mu_1$: second sensibility value.

12. The device according to claim 11, wherein the evaluation means provides the output signal indicating the presence or absence of flash gas according to the formula:

$$\text{output_signal} = \begin{cases} \text{PRESENT, when } \underline{\text{the fault indicator}}\ S_{\mu_1,i} > a \\ \text{predetermined value;} \\ \text{ABSENT, otherwise.} \end{cases}$$

13. The device according to claim 1, wherein the means for determining the first rate of heat flow comprise means for sensing heat exchange fluid temperature before and after a heat exchanger.

14. The device according to claim 1, wherein the means for determining the second rate of heat flow establishes the refrigerant heat flow according to the equation:

$$\dot{Q}_{ref} = k_{exp}(P_{con} - P_{ref,out}) \times \text{OP} \times (h_{ref,out} - h_{ref,in})$$

where $\dot{Q}_{ref}$ is the second rate of heat flow;

$k_{exp}$: proportionality constant representing the flow characteristic of the expansion device;

$P_{con}$: refrigerant pressure in the condenser;

$P_{ref,out}$: refrigerant pressure at the evaporator exit;

OP: opening period or opening passage of the expansion device;

$h_{ref,out}$: refrigerant enthalpy at the evaporator exit, based on $P_{ref,out}$; and $h_{ref,in}$: refrigerant enthalpy at the evaporator entry, based on $P_{ref,out}$.

15. The device according to claim 1, wherein the evaluation means comprises means for deriving the residual as a difference between a first value, which is made up of the mass flow of the heat exchange fluid flow and the specific enthalpy change across the heat exchanger, and a second value, which is made up of the mass flow and the specific enthalpy change of the refrigerant across the heat exchanger.

16. The device according to claim 1, wherein the device further comprises memory means for storing the output signal and means for comparing said output signal with a previously stored output signal.

17. The device according to claim 1, further comprising means for activating an alarm based on the output signal indicating presence of the flash gas.

18. A flash gas detection device for a vapour-compression refrigeration or heat pump system comprising a compressor, a condenser, an expansion device, and an evaporator interconnected by conduits providing a flow path for a refrigerant, wherein the device comprises:

means for determining a first rate of heat flow of a heat exchange fluid flow across a heat exchanger of the system and a second rate of heat flow of the refrigerant across the heat exchanger, and using the rates of heat flow for establishing an energy balance from which a residual for monitoring the refrigerant mass flow is derived; and evaluation means for evaluating the refrigerant mass flow, and providing an output signal indicating the presence or absence of flash gas, based on the residual, wherein the means for determining the second rate of heat flow uses inputs from means for sensing absolute refrigerant pressure before and after the expansion device, means for establishing an opening passage or opening period of the expansion device, and means for storing a value representing a flow characteristic of the expansion device, and determines the refrigerant mass flow according to the equation:

$$\dot{m}_{ref}=k_{exp}\cdot(P_{con}-P_{ref,out})\cdot \mathrm{OP}$$

where $\dot{m}_{ref}$: refrigerant mass flow $k_{exp}$: value representing the flow characteristic of the expansion device $P_{con}$: absolute refrigerant pressure before the expansion device $P_{ref,out}$: absolute refrigerant pressure after the expansion device OP: opening passage or opening period of the expansion device, without requiring measurement of refrigerant temperature at the expansion device entry and exit.

19. A flash gas detection device for a vapour-compression refrigeration or heat pump system comprising a compressor, a condenser, an expansion device, and an evaporator interconnected by conduits providing a flow path for a refrigerant, wherein the device comprises:

means for determining a first rate of heat flow of a heat exchange fluid flow across a heat exchanger of the system and a second rate of heat flow of the refrigerant across the heat exchanger, and using the rates of heat flow for establishing an energy balance from which a residual for monitoring the refrigerant mass flow is derived; and evaluation means for evaluating the refrigerant mass flow, and providing an output signal indicating the presence or absence of flash gas, based on the residual, wherein the means for determining the second rate of heat flow uses inputs from means for sensing absolute refrigerant pressure before and after the expansion device, means for establishing an opening passage or opening period of the expansion device, and means for storing a value representing a flow characteristic of the expansion device, and the evaluation means provides the output signal indicating the presence of the flash gas in case the time average of the residual is less than zero.

* * * * *